US007950643B2

(12) United States Patent
Kawaguchi

(10) Patent No.: US 7,950,643 B2
(45) Date of Patent: May 31, 2011

(54) SHEET FINISHER, IMAGE FORMING APPARATUS USING THE SAME, AND SHEET FINISHING METHOD

(75) Inventor: Takahiro Kawaguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/198,777

(22) Filed: Aug. 26, 2008

(65) Prior Publication Data

US 2009/0057977 A1 Mar. 5, 2009

Related U.S. Application Data

(60) Provisional application No. 60/969,910, filed on Sep. 4, 2007.

(51) Int. Cl.
*B65H 37/04* (2006.01)
*B65H 37/06* (2006.01)

(52) U.S. Cl. ..... 270/37; 493/444; 493/445

(58) Field of Classification Search ..... 270/37, 270/45; 399/407; 493/444, 445
See application file for complete search history.

(56) References Cited

U.S. PATENT DOCUMENTS 6,905,118 B2 * 6/2005 Yamada et al. ..... 270/8
2005/0162349 A1 * 7/2005 Kojima et al. ..... 345/63
2005/0189689 A1 * 9/2005 Kushida et al. ..... 270/37
2008/0315481 A1 * 12/2008 Iguchi et al. ..... 270/20.1
2008/0315482 A1 * 12/2008 Iguchi et al. ..... 270/20.1
2008/0315483 A1 * 12/2008 Iguchi et al. ..... 270/20.1
2008/0315484 A1 * 12/2008 Iguchi et al. ..... 270/20.1
2008/0315485 A1 * 12/2008 Iguchi et al. ..... 270/20.1
2008/0315486 A1 * 12/2008 Iguchi et al. ..... 270/20.1
2008/0315487 A1 * 12/2008 Iguchi et al. ..... 270/37
2008/0315488 A1 * 12/2008 Iguchi et al. ..... 270/37

FOREIGN PATENT DOCUMENTS

JP A 2003-182928 7/2003
JP A 2004-59304 2/2004
JP A 2004-106991 4/2004
JP A 2005-89140 4/2005
JP A 2005-162345 6/2005

* cited by examiner

*Primary Examiner* — Patrick Mackey
(74) *Attorney, Agent, or Firm* — Patterson & Sheridan, LLP

(57) ABSTRACT

A sheet finisher of the invention includes a saddle-stitching unit to stitch a center of a sheet bundle, a folding unit to fold the center and to form a fold, a first and a second rollers that move along a direction of the fold while nipping and pressing the fold of the sheet bundle and reinforce the fold, and a drive section to move the first and the second rollers along the fold from a standby position apart from an edge of the sheet bundle, and the first and the second rollers are separate from each other in a thickness direction of the sheet bundle at the standby position, and after the first and the second rollers reach to a position where they pass the edge of the sheet bundle of a processable maximum size, they come close to each other in the thickness direction and nip the fold.

14 Claims, 14 Drawing Sheets

TIME OF ROLLER UNIT MOVEMENT
(TIME OF FOLD REINFORCING)

ROLLER UNIT HOME POSITION

SHEET FINISHER, IMAGE FORMING APPARATUS USING THE SAME, AND SHEET FINISHING METHOD

CROSS-REFERENCE TO RELATED APPLICATIONS

This application is based upon and claims the benefit of priority from; U.S. provisional application 60/969910, filed on Sep. 4, 2007, the entire contents of each of which are incorporated herein by reference.

TECHNICAL FIELD

The present invention relates to a sheet finisher, an image forming apparatus using the same, and a sheet finishing method, and particularly to a sheet finisher to fold a printed sheet, an image forming apparatus using the same, and a sheet finishing method.

BACKGROUND

Hitherto, a sheet finisher is known which is disposed downstream of an image forming apparatus such as a copier, a printer, or a Multi-Function Peripheral (MFP) and performs finishing, such as punching or stitching, on a printed sheet.

Recently, functions of the sheet finisher are diversified, and the sheet finisher is proposed which has, in addition to the punching and stitching functions, a folding function of folding a part of a sheet, and a saddle-stitching and folding function of stapling the center of a sheet and then folding the sheet at the center (see JP-A 2004-106991, U.S. Pat. No. 6,905,118 B2, etc.)

The sheet finisher having the saddle-stitching and folding function can form (bind a book) a booklet from plural printed sheets.

In the saddle-stitching and folding proposed hitherto, after the center of sheets is stitched with a staple or the like, the stitched part is creased by a pair of rollers called fold rollers and is folded. At this time, a plate-like member called a fold blade is applied to the stitched part of the sheet bundle, and is pushed into a nip of the fold roller pair to crease the sheet bundle.

However, a time in which the folded part of the sheet bundle is pressed by the nip of the fold rollers is short, and since the whole folded part is simultaneously pressed by the nip of the fold rollers, the pressure is dispersed to the whole fold. Thus, the fold formed by the fold rollers becomes the fold to which a sufficient pressure is not applied. Especially, when the number of sheets is large, or when the sheet bundle includes a thick sheet, an incomplete fold is often formed.

In order to deal with this problem, JP-A 2004-106991 or U.S. Pat. No. 6,905,118 B2 discloses a technique in which a roller called a reinforce roller is separately provided, and the fold formed by the fold rollers is reinforced by this reinforce roller.

In the technique disclosed in JP-A 2004-106991 or U.S. Pat. No. 6,905,118 B2, the sheet bundle pushed out from the fold rollers is temporarily stopped on a guide plate, and the reinforce roller is moved along the fold while applying a pressure from above to the fold of the sheet bundle. The fold nipped between the guide plate and the reinforce roller is reinforced by the pressure generated between the guide plate and the reinforce roller.

However, in the technique disclosed in JP-A 2004-106991 or U.S. Pat. No. 6,905,118 B2, since the pressure is applied to the fold between the reinforce roller and the plane guide plate, it is anticipated that the pressing force of the reinforce roller is diffused by the plane guide plate, and the pressure to reinforce the fold is not effectively applied to the fold.

A method is conceivable in which a fold is nipped by the nip of a pair of reinforce rollers, the pair of reinforce rollers are moved along the fold while applying a pressure to the nip, and the fold is reinforced. In this method, since the force of pressing the pair of reinforce rollers to each other can be concentrated on one point of the nip, the high pressure is generated at the nip, and the fold can be more effectively reinforced.

Specifically, one reinforce roller (first roller) of the pair can be made to freely rotate in a state where the position is fixed in the thickness direction of a sheet bundle. Meanwhile, the other reinforce roller (second roller) of the pair can be made to freely rotate similarly to the first roller, and can be made to move in the thickness direction while applying an urging force by an elastic member, such as a spring, in the thickness direction of the sheet bundle.

The pair of reinforce rollers having the structure as stated above contact and press to each other by the urging force of the elastic member in an outside region of the sheet bundle in the width direction. When the reinforce roller pair moves from the outside region of the sheet bundle to the edge (edge of the fold) of the sheet bundle, the second roller gets over the edge of the sheet bundle against the urging force of the elastic member, and then moves while pressing the fold by the urging force, and reinforces the fold.

When the sheet size is middle or less (for example, A4 size or less), a region outside the sheet bundle in the width direction can be ensured to a certain degree. Thus, after the reinforce roller pair starts to move from the standby position and before the pair reaches the edge of the sheet bundle, a moving speed of a certain degree can be obtained and the reinforce roller pair can easily get over the edge of the sheet bundle. However, when the sheet size is the maximum size (for example, A3 size) among the processable sizes, the region outside the sheet bundle in the width direction can be hardly ensured. Thus, there can occur a state in which a sufficient moving speed can not be obtained after the reinforce roller pair starts to move from the standby position and before the pair reaches the edge of the sheet bundle, and the reinforce roller pair can not get over the edge of the sheet bundle. In order to obtain the sufficient moving speed, it is necessary to additionally provide an area for run-up at the outside of the sheet width of the maximum size, which becomes a factor to increase the size of the apparatus.

SUMMARY

The invention is made in view of the above circumstances, and it is an object to provide a sheet finisher which performs saddle-stitching and folding and can stably reinforce a fold of a sheet of from a small size to a large size and irrespective of the sheet size, an image forming apparatus using the same, and a sheet finishing method.

In order to achieve the object, an aspect of a sheet finisher includes a saddle-stitching unit configured to stitch a center of a sheet bundle, a folding unit configured to fold the center and to form a fold, a first and a second rollers that move along a direction of the fold while nipping and pressing the fold of the sheet bundle conveyed from the folding unit and reinforce the fold, and a drive section configured to move the first and the second rollers along the direction of the fold from a standby position apart from an edge of the sheet bundle, and the first and the second rollers are separate from each other in a thickness direction of the sheet bundle at the standby position, and after the first and the second rollers reach to a position where they pass the edge of the sheet bundle of a processable maximum size, they come close to each other in the thickness direction and nip the fold.

Besides, another aspect of an image forming apparatus includes a reading section configured to read an original document and to form image data, an image forming section configured to print the image data on a sheet, a saddle-stitching unit configured to stitch a center of a printed sheet bundle, a folding unit configured to fold the center and to form a fold, a first and a second rollers that move along a direction of the fold while nipping and pressing the fold of the sheet bundle conveyed from the folding unit and reinforce the fold, and a drive section configured to move the first and the second rollers along the direction of the fold from a standby position apart from an edge of the sheet bundle, and the first and the second rollers are separate from each other in a thickness direction of the sheet bundle at the standby position, and after the first and the second rollers reach to a position where they pass the edge of the sheet bundle of a processable maximum size, they come close to each other in the thickness direction and nip the fold.

Besides, another aspect of a sheet finishing method includes stitching a center of a sheet bundle, folding the center to form a fold, and reinforcing the fold by nipping and pressing the fold by a first and a second rollers and moving them along a direction of the fold, and at the reinforcing the fold, when the first and the second rollers are at a standby position apart from an edge of the sheet bundle, they are separated from each other in a thickness direction of the sheet bundle, and after the first and the second rollers reach to a position where they pass the edge of the sheet bundle of a processable maximum size, they come close to each other in the thickness direction and nip the fold.

DESCRIPTION OF THE DRAWINGS

In the accompanying drawings.

DETAILED DESCRIPTION

Embodiments of a sheet finisher and an image forming apparatus will be described with reference to the accompanying drawings.

(1) Structure of the Image Forming Apparatus

Figure 1:
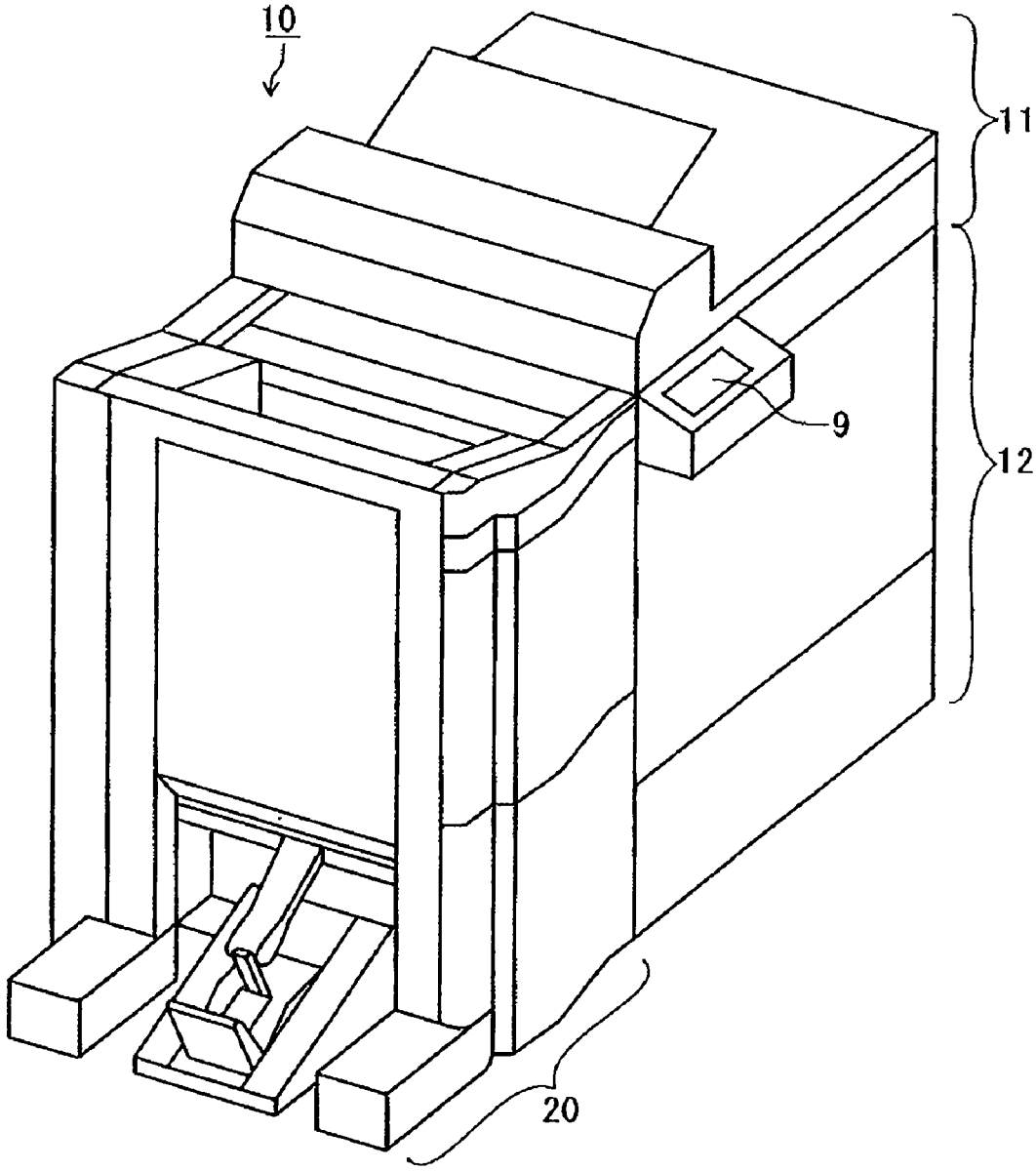
FIG. 1 is a perspective view showing an outer appearance example of an image forming apparatus.

FIG. 1 is an outer appearance perspective view showing a basic structural example of an image forming apparatus 10 of an embodiment. The image forming apparatus 10 includes a reading section 11 to read an original document, an image forming section 12 to print image data of the read original document on a sheet by an electrophotographic system, and a sheet finisher 20 to perform finishing such as sorting, punching, folding, or saddle-stitching on the printed sheet. The image forming section 12 is provided with an operation section 9 by which a user performs various operations.

Figure 2:
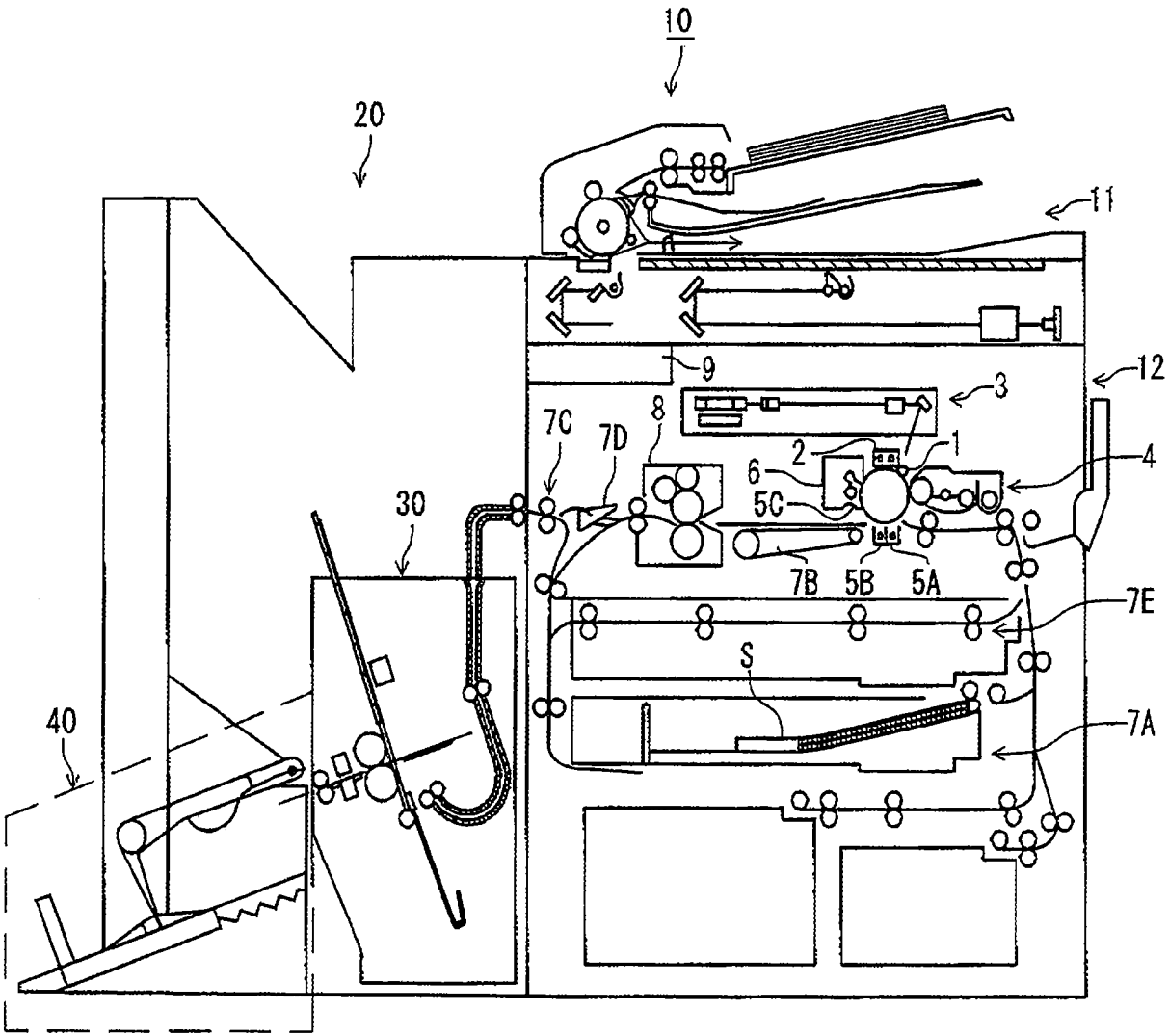
FIG. 2 is a sectional view showing a structural example of the image forming apparatus.

FIG. 2 is a sectional view shown a detailed structural example of the image forming apparatus 10.

The image forming section 12 of the image forming apparatus 10 includes a photoconductive drum 1 in the center. Around the photoconductive drum 1, a charging unit 2, an exposure unit 3, a developing unit 4, a transfer unit 5A, a charge removing unit 5B, a separation pawl 5C, and a cleaning unit 6 are respectively disposed. Besides, a transfer unit 8 is disposed downstream of the charge removing unit 5B. An image forming process is performed by these units roughly in a following procedure.

First, the charging unit 2 uniformly charges the surface of the photoconductive drum 1. An original document read by the reading section 11 is converted into image data, and is inputted to the exposure unit 3. The exposure unit 3 irradiates a laser beam corresponding to the level of the image data to the photoconductive drum 1, and forms an electrostatic latent image on the photoconductive drum 1. The electrostatic latent image is developed with toner supplied from the developing unit 4, and a toner image is formed on the photoconductive drum 1.

Meanwhile, a sheet contained in a sheet containing unit 7 is conveyed to a transfer position (a gap between the photoconductive drum 1 and the transfer unit 5A) by some conveyance rollers. At the transfer position, the toner image is transferred from the photoconductive drum 1 to the sheet by the transfer unit 5A. Electric charge on the surface of the sheet to which the toner image is transferred is removed by the charge removing unit 5B, and the sheet is separated from the photoconductive drum 1 by the separation pawl 5C. Thereafter, the sheet is conveyed by an intermediate conveyance unit 7B, and is heated and pressed by the fixing unit 8 so that the toner image is fixed to the sheet. The sheet in which the fixing process is ended is discharged from a discharge section 7C and is outputted to the sheet finisher 20.

A developer remaining on the surface of the photoconductive drum 1 is removed by the cleaning unit 6 at the downstream side of the separation pawl 5C, and preparation is performed for next image formation.

When duplex printing is performed, a path of the sheet on the front side of which the toner image is formed is made to branch from a normal discharge path by a conveyance path switching plate 7D, and the sheet is switched back in an inversion conveyance section 7E to invert the front and back sides. A print process similar to that of single-side printing is performed on the back side of the inverted sheet, and the sheet is outputted to the sheet finisher 20 from the discharge section 7C.

The sheet finisher 20 includes a saddle-stitching section 30 and a sheet bundle loading section 40 in addition to a sorter section to sort sheets.

The saddle-stitching section 30 performs a process (saddle-stitching) in which the center of plural printed sheets discharged from the image forming section 12 is stitched with staples, and then, the sheets are folded to form a booklet.

The booklet subjected to the saddle-stitching by the saddle-stitching section 30 is outputted to the sheet bundle loading section 40, and the bound booklet is finally loaded here.

Figure 3:
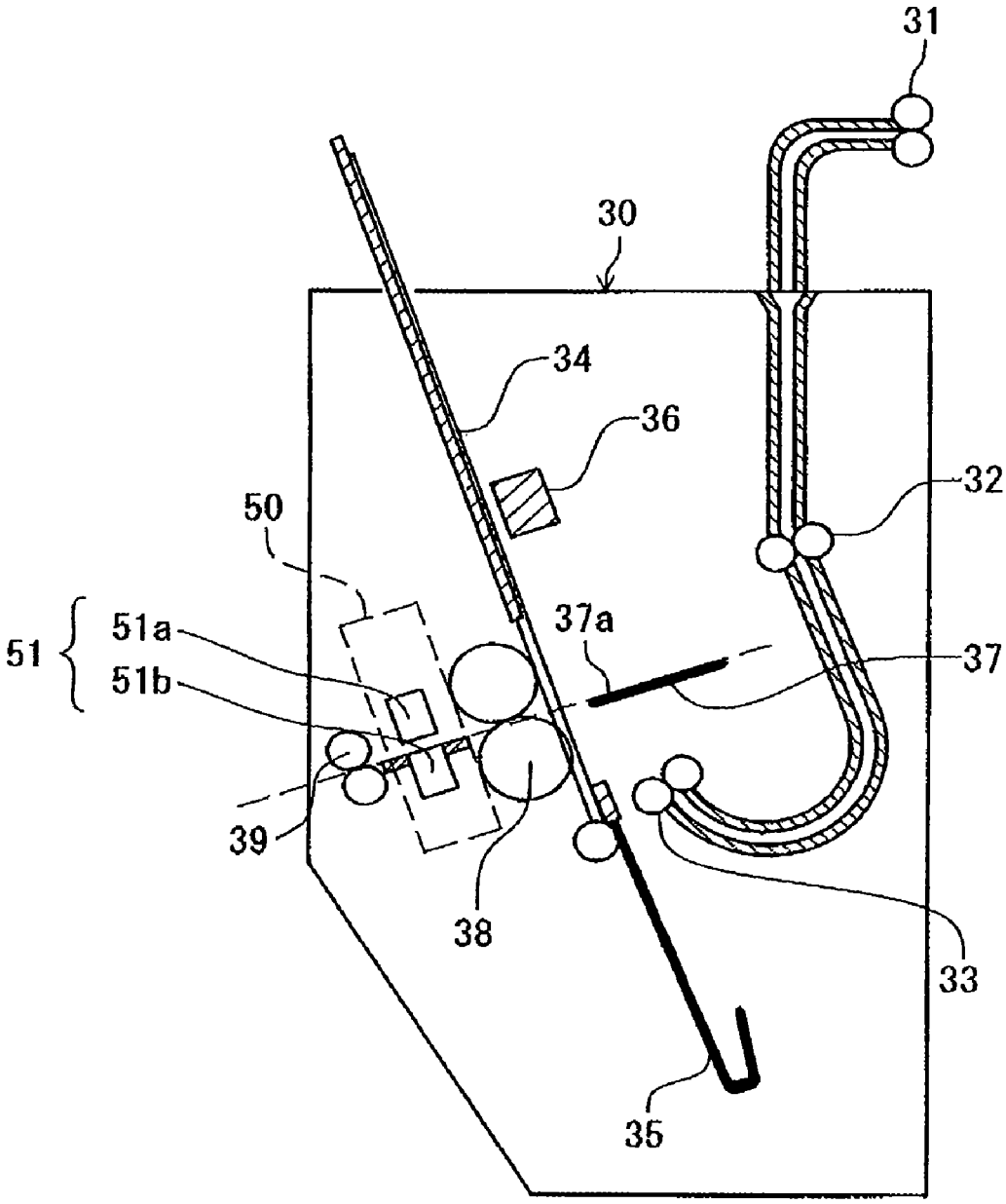
FIG. 3 is a sectional view showing a structural example of a saddle-stitching section.

FIG. 3 is a sectional view showing a detailed structural example of the saddle-stitching section 30.

In the saddle-stitching section 30, the sheet discharged from the discharge section 7C of the image forming section 12 is received by an inlet roller pair 31 and is delivered to an intermediate roller pair 32. The intermediate roller pair 32 further delivers the sheet to an outlet roller pair 33. The outlet roller pair 33 sends the sheet to a standing tray 34 having an inclined loading surface. The lead edge of the sheet moves to an upper part of the inclination of the standing tray 34.

A stacker 35 stands by below the standing tray 34, and receives the lower edge of the sheet which is switched back and drops from the upper part of the inclination of the standing tray 34.

A stapler (saddle-stitching unit) 36 is disposed at the middle of the standing tray 34. When the sheet bundle is subjected to saddle-stitching (stapling), the position of the stacker 35 is adjusted so that the position (the center of the sheet bundle in the up-and-down direction) where the sheet bundle is to be stapled faces the stapler 36.

When the sheet bundle is saddle-stitched by the stapler 36, the stacker 35 moves down until the position (the center of the sheet bundle in the up-and-down direction and the position where staples were driven) where a fold of the sheet bundle is to be formed reaches the front of a fold blade 37.

When the position where the fold is to be formed reaches the front of the fold blade 37, a leading edge 37*a* of the fold blade 37 pushes the surface which becomes the inner surface after the sheet bundle is folded.

A fold roller pair 38 is provided ahead of the fold blade 37 in the traveling direction. The sheet bundle pushed into by the fold blade 37 is rolled into a nip of the fold roller pair 38, and the fold is formed at the center of the sheet bundle. The folding unit includes the fold blade 37 and the fold roller pair 38.

The sheet bundle on which the fold is formed by the fold roller pair 38 is conveyed to a fold reinforcing unit 50 provided downstream thereof. The sheet bundle conveyed to the fold reinforcing unit 50 is temporarily stopped there.

The fold reinforcing unit 50 is provided with a reinforce roller pair 51 (an upper roller (second roller) 51*a* and a lower roller (first roller) 51*b*). The reinforce roller pair 51 moves in a direction (direction along the line of the fold) orthogonal to the conveyance direction of the sheet bundle while applying a pressure, and reinforces the fold.

The sheet bundle whose fold was reinforced by the fold reinforcing unit 50 again starts to be conveyed, is drawn by a discharge roller pair 39 and is outputted to the sheet bundle loading section 40. The sheet bundle (booklet) subjected to the saddle-stitching is loaded on the sheet bundle loading section 40.

The embodiment mainly has features in the structure, function and operation of the fold reinforcing unit 50, and hereinafter, the structure, function and operation of the fold reinforcing unit 50 will be described in detail.

(2) Structure and Operation of the Fold Reinforcing Unit

Figure 4:
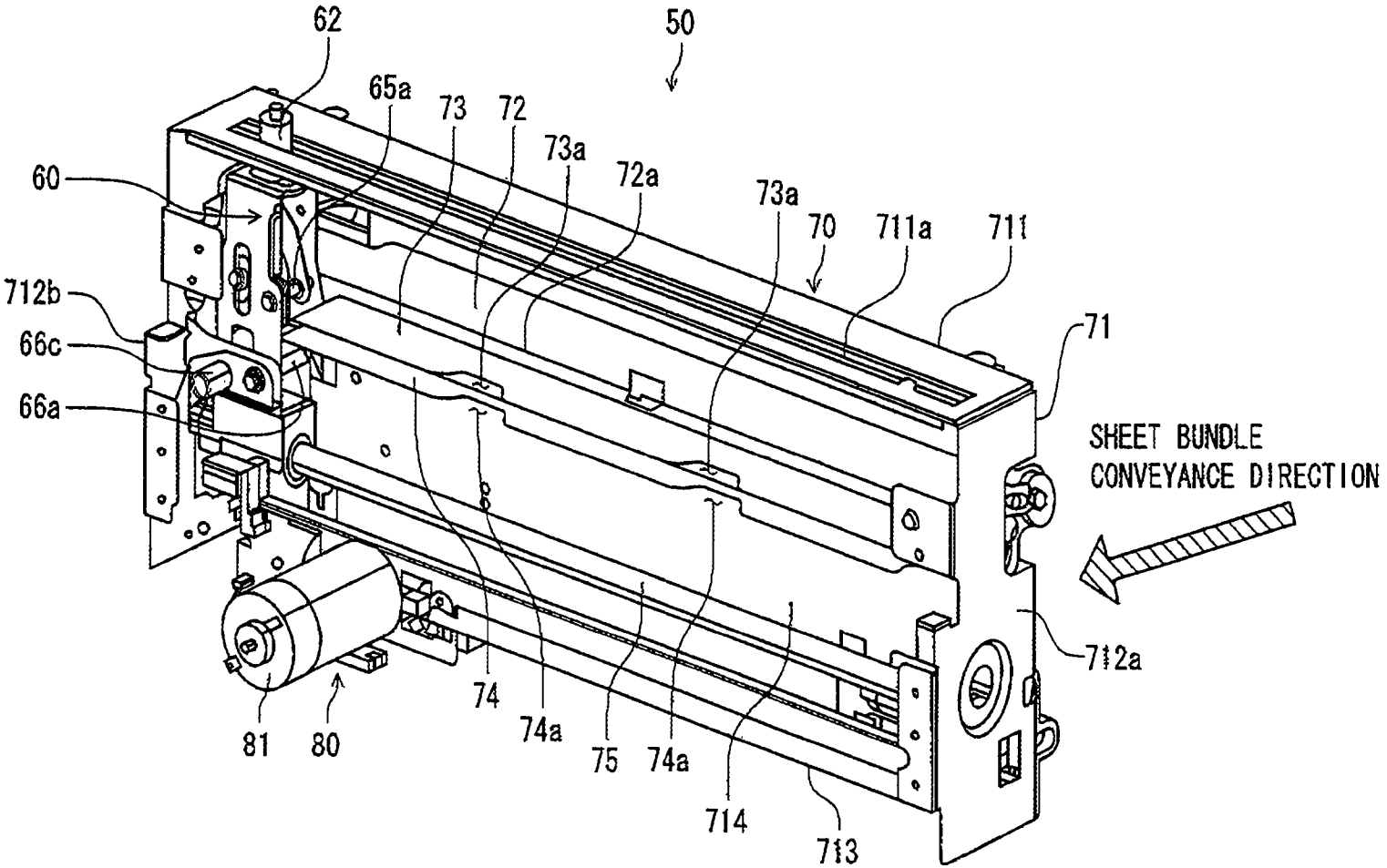
FIG. 4 is a perspective outer appearance view showing a whole structure of a fold reinforcing unit.

FIG. 4 is a perspective outer appearance view showing the whole structure of the fold reinforcing unit 50. The fold reinforcing unit 50 includes a reinforce roller unit 60 (hereinafter simply referred to as a roller unit 60), a support section 70, and a drive section 80.

The roller unit 60 includes a reinforce roller pair 51. The reinforce roller pair 51 nips and presses the fold of the sheet bundle pushed out from the fold roller pair 38 positioned at the upstream side, and moves along the fold to reinforce the fold.

The support section 70 supports the roller unit 60 slidably in the fold direction, and includes nip members of the sheet bundle and structure members of the whole fold reinforcing unit 50.

The drive section 80 includes a drive motor 81, and this drive motor 81 drives the roller unit 60 along the fold.

Figure 5B:
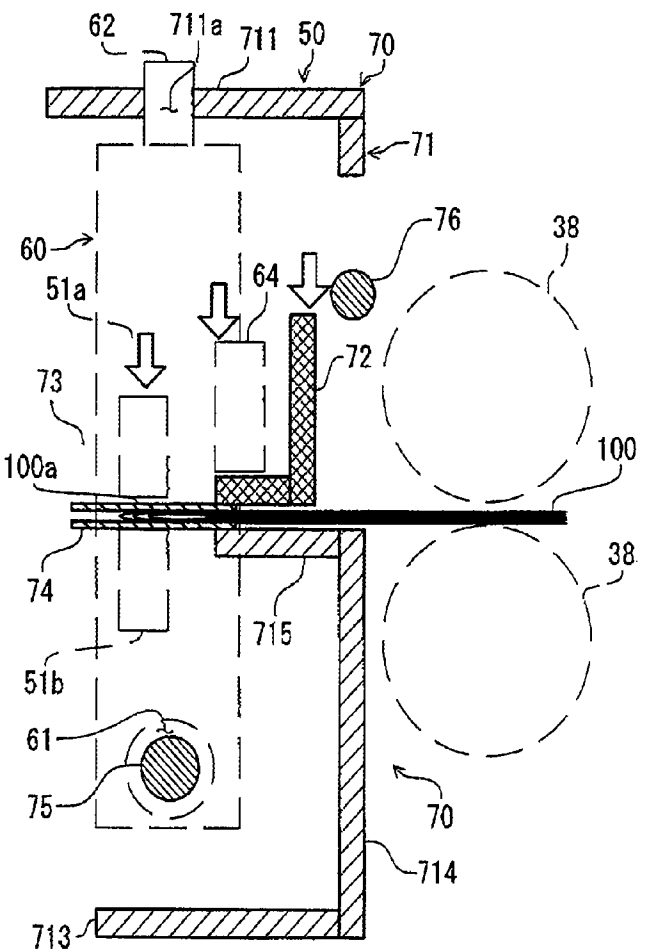
FIGS. 5A and 5B are schematic sectional views for mainly explaining a structure of a support section.
Figure 5A:
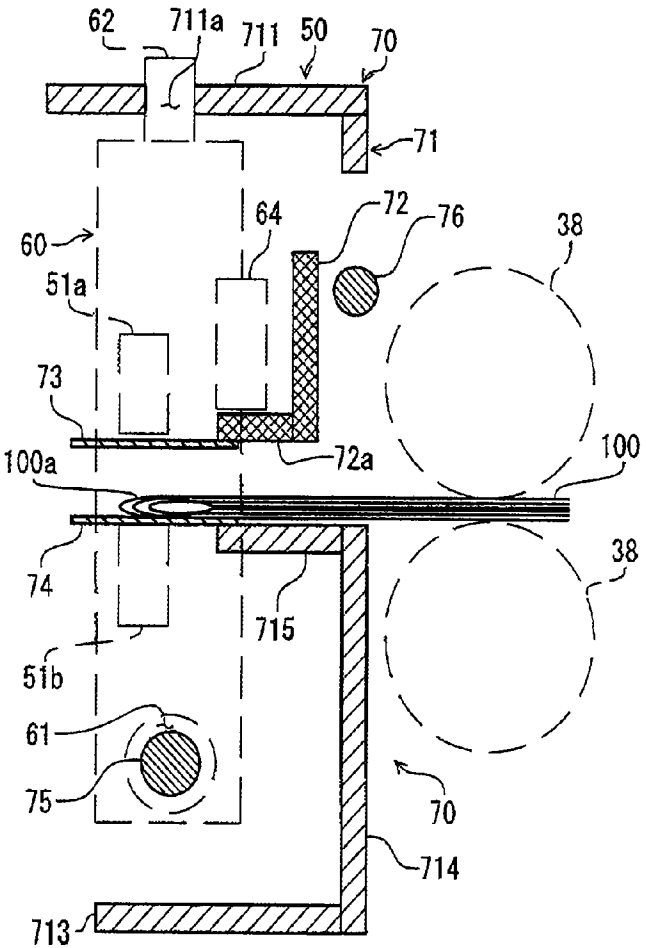

Among the roller unit 60, the support section 70, and the drive section 80, first, a structure of the support section 70 will be described with reference to FIG. 4 and FIGS. 5A and 5B. FIGS. 5A and 5B are schematic sectional views for explaining the structure of the support section 70. FIG. 5A is a sectional view when the roller unit 60 is at a home position (standby position: position of the left end in FIG. 4), and FIG. 5B is a sectional view when the roller unit 60 is moving (reinforcing the fold).

The support section 70 includes a frame 71, and the frame 71 includes a top plate 711, a right and a left side plates 712*a* and 712*b*, a bottom plate 713, a back plate 714, a sheet bundle loading table (first nip plate) 715 (see FIG. 5A, FIG. 5B, etc.) and the like.

The top plate 711 is provided with a support hole 711*a* extending in the longitudinal direction.

A support shaft 75 to support the roller unit 60, a conveyance guide 72 having an L-shaped cross section, a drive shaft 76 for driving the conveyance guide 72 in the up-and-down direction (see FIG. 5A, FIG. 5B, etc.) are provided between both the side plates 712*a* and 712*b*.

A band-like flexible member (second flexible member) 73 formed of a resin member such as film-like polyethylene terephthalate (PET) extends from a bottom plate (second nip plate) 72*a* of the conveyance guide 72. A similar flexible member (first flexible member) 74 extends also from the sheet loading table (first nip plate) 715.

Incidentally, the sheet bundle loading table (first nip plate) 715, the flexible member (first flexible member) 74, the bottom plate (second nip plate) 72*a* of the conveyance guide 72, and the flexible member (second flexible member) 73 constitute a nip section.

As shown in FIG. 5A and FIG. 5B, a fold 100*a* of a sheet bundle 100 is nipped between the flexible members 73 and 74, and is pressed by the reinforce roller pair 51 (the upper roller 51*a* and the lower roller 51*b*) through the flexible members 73 and 74 so that the fold is reinforced. The flexible members 73 and 74 prevent the occurrence of flaws or wrinkles of the sheet bundle.

The leading edges of the flexible members 73 and 74 are provided with notches 73*a* and 74*b*. The notches 73*a* and 74*b* are provided at positions corresponding to positions of staples of the fold, and prevent the flexible members 73 and 74 from being damaged by the staples.

As described later, a through hole 61 for allowing the support shaft 75 to pass therethrough is provided in a lower part of the roller unit 60. A support roller 62 for posture holding is provided in an upper part of the roller unit 60, and the support roller 62 moves along the support hole 711*a* provided in the top plate 711.

The position (except the position change in the movement direction) of the roller unit 60 and the attitude of three-axis are regulated by the support shaft 75 and the through hole 61, together with the support hole 711*a* and the support roller 62, and are kept unchanged during the movement of the roller unit 60.

Figure 6:
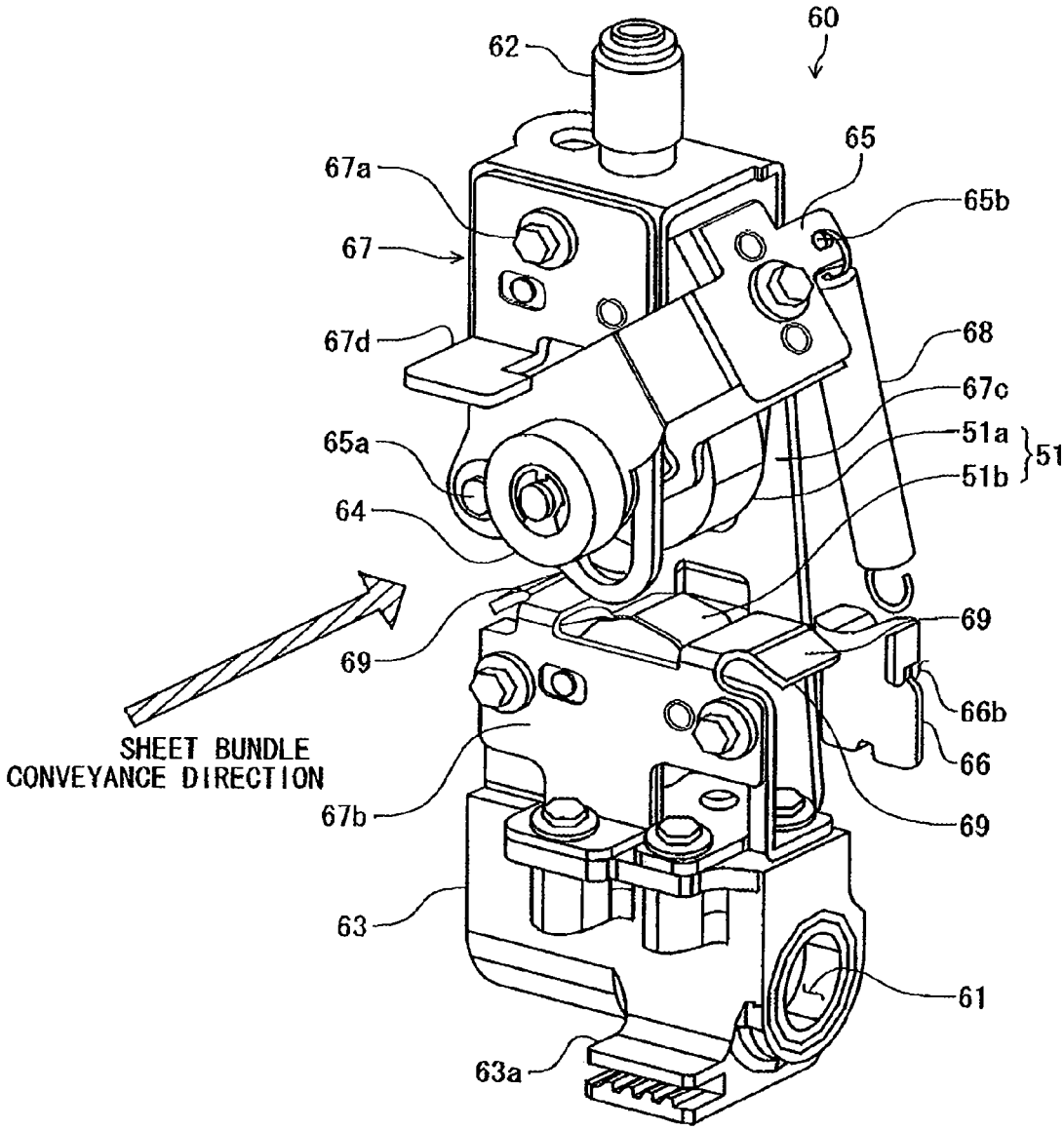
FIG. 6 is a perspective outer appearance view showing a structural example of a roller unit.

Next, the structure of the roller unit 60 will be described. FIG. 6 is a perspective outer appearance view showing a structural example of the roller unit 60, and is a view in which the roller unit is seen from the sending source direction (opposite direction to FIG. 4) of the sheet bundle.

The roller unit 60 is the unit to incorporate the reinforce roller pair 51, and includes a unit support section 63 which is positioned at a lower part and is provided with the through hole 61, and a roller frame 67 fixed to an upper part of the unit support section 63.

In the roller frame 67, an upper frame 67*a* having a hollow part and a lower frame 67*b* having a hollow part are fixed and coupled to each other by a frame plate 67*c*.

Besides, the roller unit 60 includes an upper link member (second link member) 65 and a lower link member (first link member) 66, and both are spring coupled to each other by a spring 68. One end of the spring 68 is engaged with a hook hole 65*b* of the upper link member 65, and the other end of the spring 68 is engaged with a notch 66*b* of the lower link member 66. FIG. 6 shows the spring 68 in a free state in which the other end of the spring 68 is disengaged from the notch 66*b*. In the state where the other end of the spring 68 is actually engaged with the notch 66*b*, the pulling force of the spring 68 is applied between the upper link member 65 and the lower link member 66.

The lower roller 51*b* as one of the reinforce roller pair 51 is contained in the hollow part of the lower frame 67*b*. The lower roller 51*b* is freely rotatably supported around a lower roller shaft (not shown) fixed to the lower frame 67*b*.

The lower link member 66 is rotatably coupled to the side of the lower frame 67*b* through a lower link shaft 66*a* (see FIG. 4) fixed to the lower frame 67*b*.

The upper roller 51*a* as one of the reinforce roller pair 51 is contained in the hollow part of the upper frame 67*a*. The upper roller 51*a* is freely rotatably supported around an upper roller shaft (not shown) fixed to the upper link member 65 (not the upper frame 67*a*).

The rotation shaft (lower roller shaft) of the lower roller 51*b* is fixed to the lower frame 67*b* (that is, fixed to the roller frame 67), and even if the roller unit 60 moves, the position of the lower roller 51*b* does not change in the up-and-down direction. The position of the upper end of the lower roller 51*b* is adjusted to become the same position as the flexible member 74, and when the roller unit 60 moves, the lower roller 51*b* rotates while contacting with the lower surface of the flexible member 74.

On the other hand, the upper roller shaft of the roller 51*a* is fixed to the upper link member 65. When the roller unit 60 goes away from the home position and starts to move, the upper link member 65 is pulled by the spring 68 and starts to rotate downward around the upper link shaft 65*a*. By this rotation, the upper roller 51*a* rotatably attached to the upper link member 65 starts to go down, and moves to a position where it contacts with the lower roller 51*b*. The pressing force caused by the pulling force of the spring 68 is mutually exerted between the upper roller 51*a* and the lower roller 51*b*. Actually, since the sheet bundle is nipped between the upper roller 51*a* and the lower roller 51*b* through the flexible members 73 and 74, the fold of the sheet bundle is reinforced by the pressing force between the upper roller 51*a* and the lower roller 51*b*.

Figure 7:
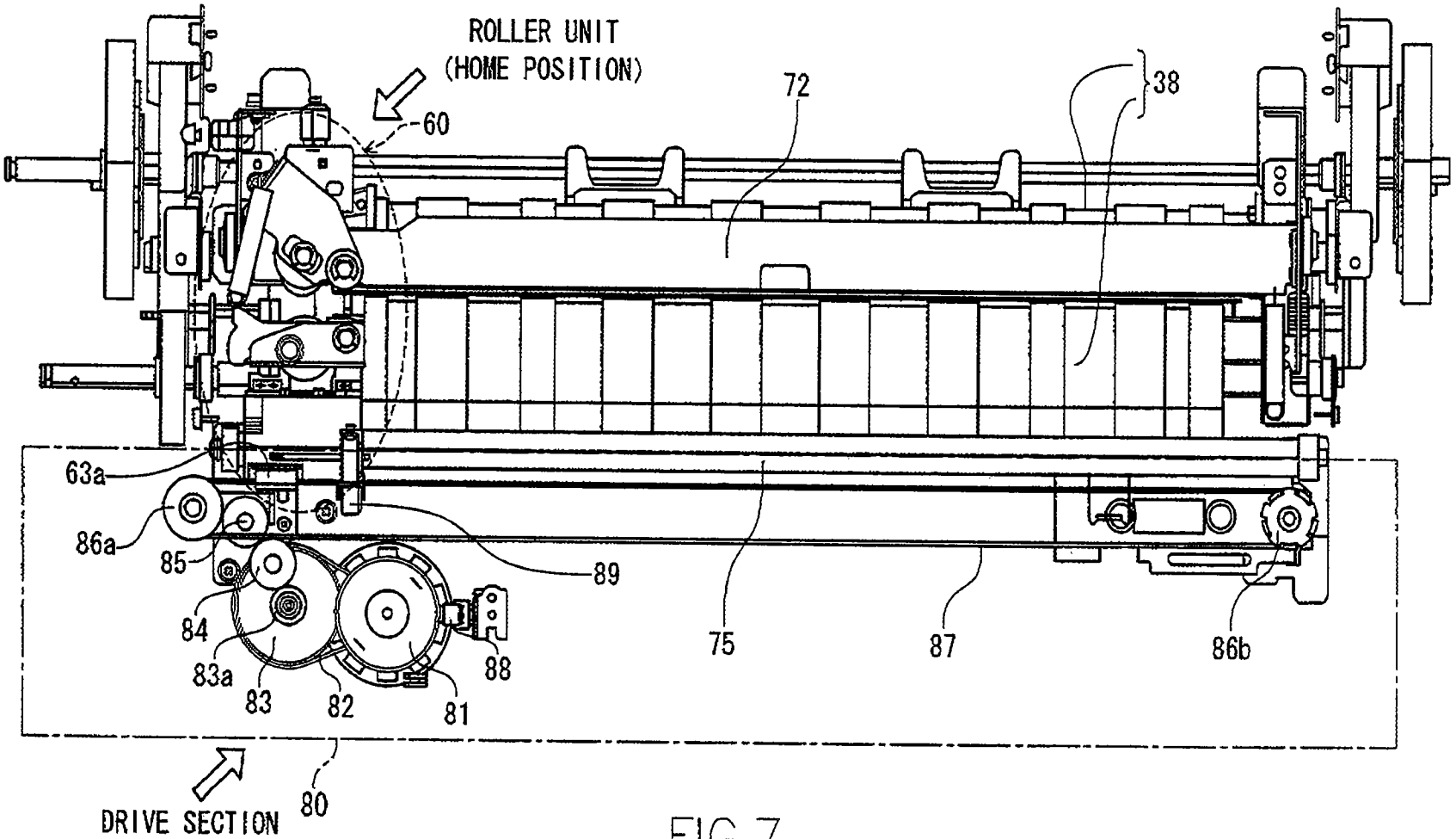
FIG. 7 is a view in which the fold reinforcing unit is seen from the conveyance destination of a sheet bundle.

Next, the structure of the drive section 80 will be described. FIG. 7 is a view showing the configuration of the drive section 80 and a structural example. FIG. 7 is a view in which the conveyance source direction is seen from the conveyance destination of the sheet bundle, and also shows the roller unit 60 at the home position, the fold roller pair 38 and a drive mechanism of the fold roller pair 38. The illustration of structural members of the support section 70 is partially omitted for convenience of explanation.

The drive section 80 includes a drive motor 81 as only one drive source of the fold reinforcing unit 50. The drive motor 81 is a DC motor, and the rotation direction and rotation speed can be controlled from outside.

The drive force of the drive motor 81 is transmitted to a pulley 83 through a motor belt 82, and is further transmitted from a gear 83*a* of the pulley 83 to a drive side pulley 86*a* through a gear 84 and a gear 85. A unit drive belt 87 is stretched between the drive side pulley 86*a* and a driven side pulley 86*b*. The unit drive belt 87 is moved between the drive side pulley 86*a* and the driven side pulley 86*b* by the drive force of the drive motor 81.

A rack is formed on the surface of the unit drive belt 87, and the rack and teeth of a fitting section 63*a* (see FIG. 6) provided at a lower part of the roller unit 60 are fitted to each other, so that the roller unit 60 can be certainly moved in the fold direction without sliding. The movement direction of the unit drive belt 87 can be changed by reversing the rotation direction of the drive motor 81, and the roller unit 60 can be reciprocated.

The movement amount and movement speed of the unit drive belt 87, that is, the movement amount and movement speed of the roller unit 60 can be controlled by rotation control of the drive motor 81. The rotation amount and rotation speed of the drive motor 81 are detected by a train of pulse signals outputted from an encoder sensor 88, and the rotation control of the drive motor 81 is performed based on the detected rotation amount and rotation speed.

The drive motor 81 may be constructed of a pulse motor. In this case, the rotation speed can be detected by counting pulses directly outputted from the drive motor 81.

Figure 8:
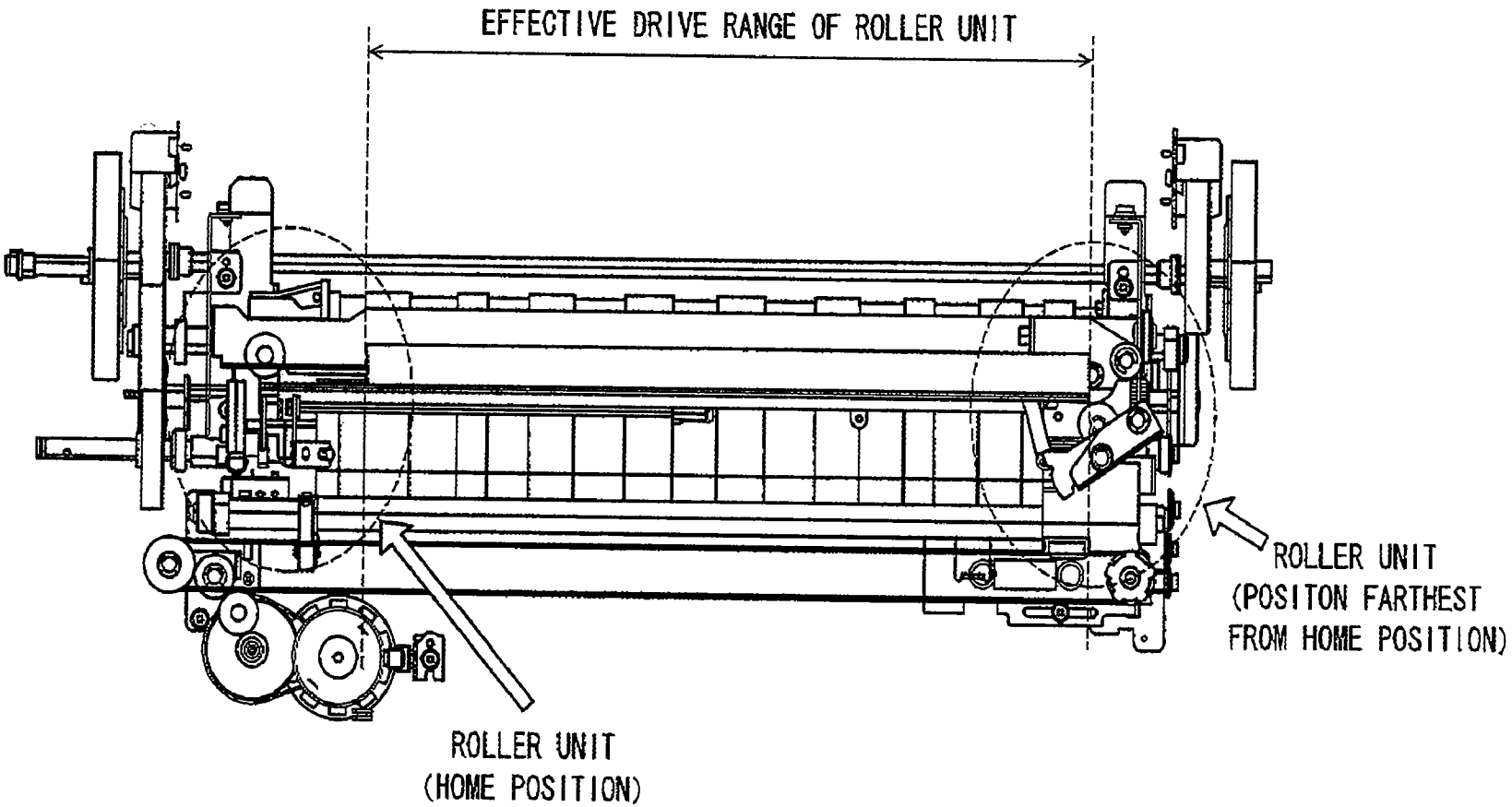
FIG. 8 is a view for explaining an effective drive range of the roller unit.

FIG. 8 is a view showing a relation between an effective drive range of the roller unit 60 and a width of a processable maximum sheet size (for example, A3 size). As shown in FIG. 8, the home position of the roller unit 60 is set at a position where even the sheet bundle of the processable maximum size does not interference. A position of the roller unit 60 farthest from the home position is set to the farthest position within the range where the nip of the reinforce roller pair 51 does not pass the edge of the sheet bundle of the processable maximum size.

The roller unit 60 goes away from the home position and starts to move, moves along the fold while reinforcing the fold, and once stops at the edge of the sheet bundle on the opposite side of the home position. Thereafter, the roller unit moves on a return path while reinforcing the fold continuously, and returns to the home position.

The position where the roller unit once stops at the edge of the sheet bundle on the opposite side of the home position varies according to the sheet size, and the once stop position is determined based on the information of the sheet size.

In the fold reinforcing unit 50, the up-and-down driving of the upper roller 51*a* in the inside of the roller unit 60, and the up-and-down driving of the conveyance guide 72 are also performed in addition to the movement of the roller unit 60 in the fold direction. Both drive sources of these up-and-down drivings are the drive motor 81. That is, all the drive operations in the fold reinforcing unit 50 are performed by the single drive motor 81. Hereinafter, the mechanism of the up-and-down driving of the upper roller 51*a* and the mechanism of the up-and-down driving of the conveyance guide 72 will be described in sequence.

Figure 9:
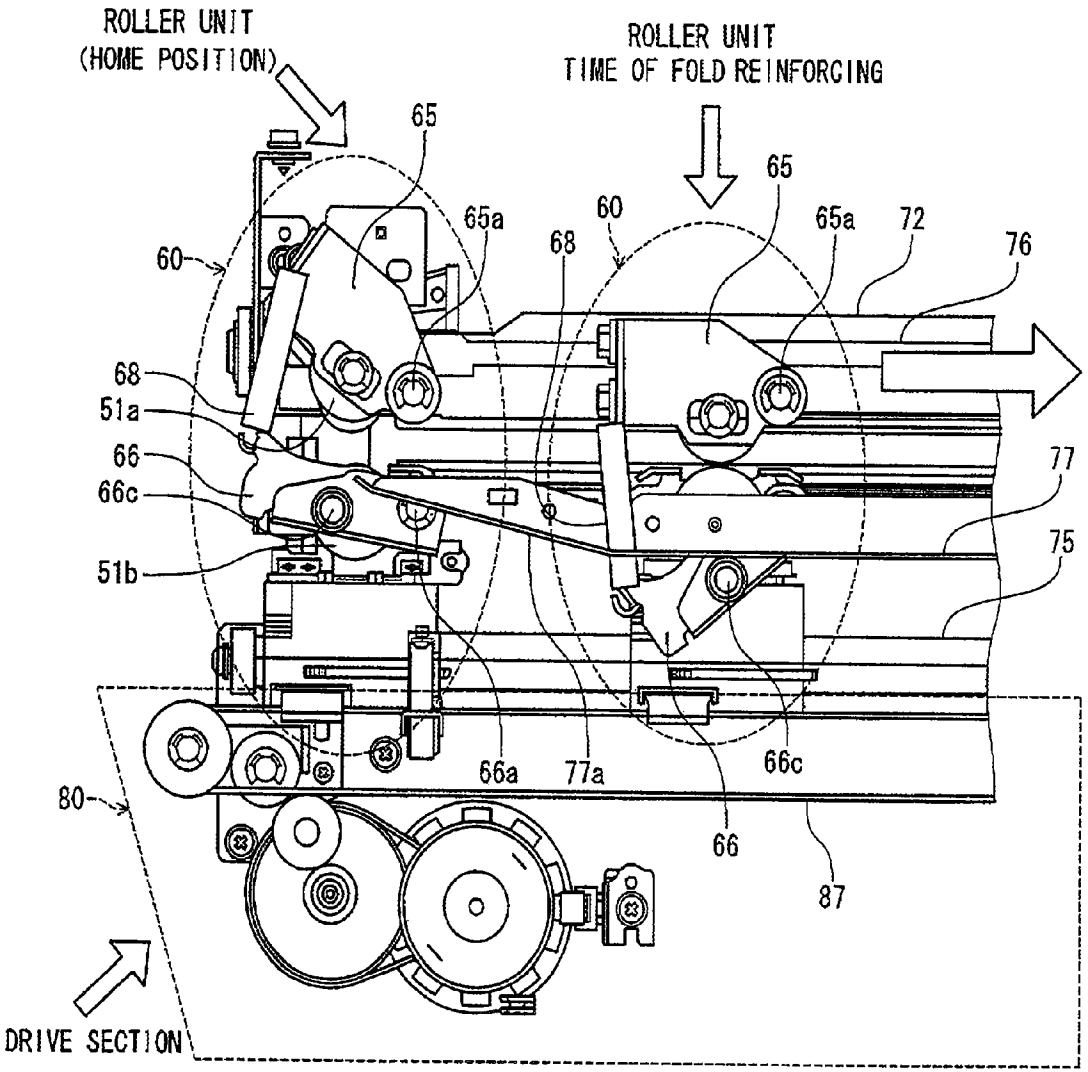
FIG. 9 is a first view for explaining a mechanism of up-and-down driving of an upper roller.
Figure 10:
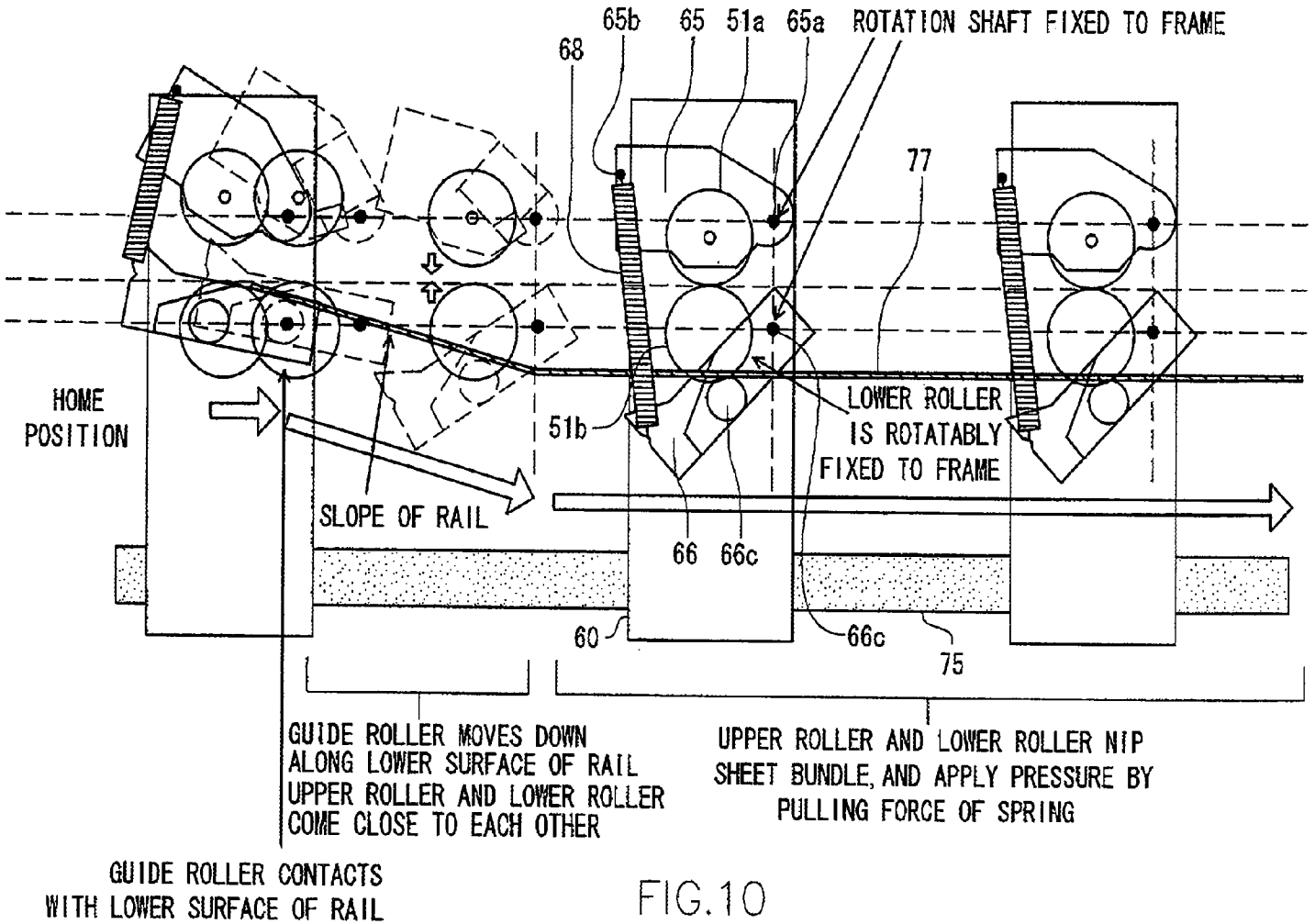
FIG. 10 is a second view for explaining the mechanism of the up-and-down driving of the upper roller.

FIG. 9 and FIG. 10 are views for explaining the mechanism of the up-and-down driving of the upper roller 51*a*. As described above, the upper link member 65 and the lower link member 66 of the roller unit 60 are spring coupled to each other by the spring 68 at the position farthest from the respective rotation shafts (65*a*, 66*a*). The lower link member 66 is provided with a freely rotating guide roller 66*c* (see FIG. 4).

As shown in FIG. 9, the support section 70 includes a guide rail 77 having an L-shaped cross section. The guide rail 77 includes an inclined section 77*a*, and is parallel to the fold direction of the sheet bundle except for the inclined section 77*a*.

When the roller unit 60 is driven by the drive belt 87 and goes away from the home position, as shown in FIG. 10, the guide roller 66*c* contacts with the bottom surface of the inclined section 77*a* of the guide rail 77. Thereafter, the guide roller 66*c* moves down along the bottom surface of the inclined section 77*a*. As the guide roller 66*c* moves down, the lower link member 66 rotates in the counterclockwise direction in FIG. 10 around the lower link shaft 66*a*. Besides, the upper link member 65 is also pulled by the spring 68, and rotates in the counterclockwise direction around the upper link shaft 65*b*. As a result, while the roller unit 60 moves on the inclined section 77*a*, the upper roller 51*a* positioned between the upper link shaft 65*b* and the hook hole 65*b* of the spring 68 gradually moves down, and the interval between the upper roller 51*a* and the lower roller 51*b* becomes gradually short. The upper roller 51*a* and the lower roller 51*b* contact with each other at the position where the inclined section 77*a* terminates. Alternatively, the upper roller 51*a* and the lower roller 51*b* may contact with each other before reaching the position where the inclined section 77*a* terminates. At this time, between the upper roller 51*a* and the lower roller 51*b*, the pressure (pressing force) to press them to each other are exerted. The pressing force is based on the pulling force of the spring 68.

In the horizontal region of the guide rail 77 (that is, the effective drive region), the upper roller 51*a* and the lower roller 51*b* apply the pressure to the fold of the sheet bundle while keeping the pressing force, and reinforces the fold.

Next, the mechanism of the up-and-down driving of the conveyance guide 72 will be described. As shown in FIG. 5A, when the roller unit 60 is at the home position, the conveyance guide 72 is raised upward, and the sheet bundle 100 is conveyed through an opening between the bottom plate 72*a* of the conveyance guide 72 and the sheet bundle loading table 715. On the other hand, as shown in FIG. 5B, when the roller unit 60 moves into the effective movement range and performs the fold reinforcing operation, the conveyance guide 72 moves down and nips the sheet bundle.

Figure 11:
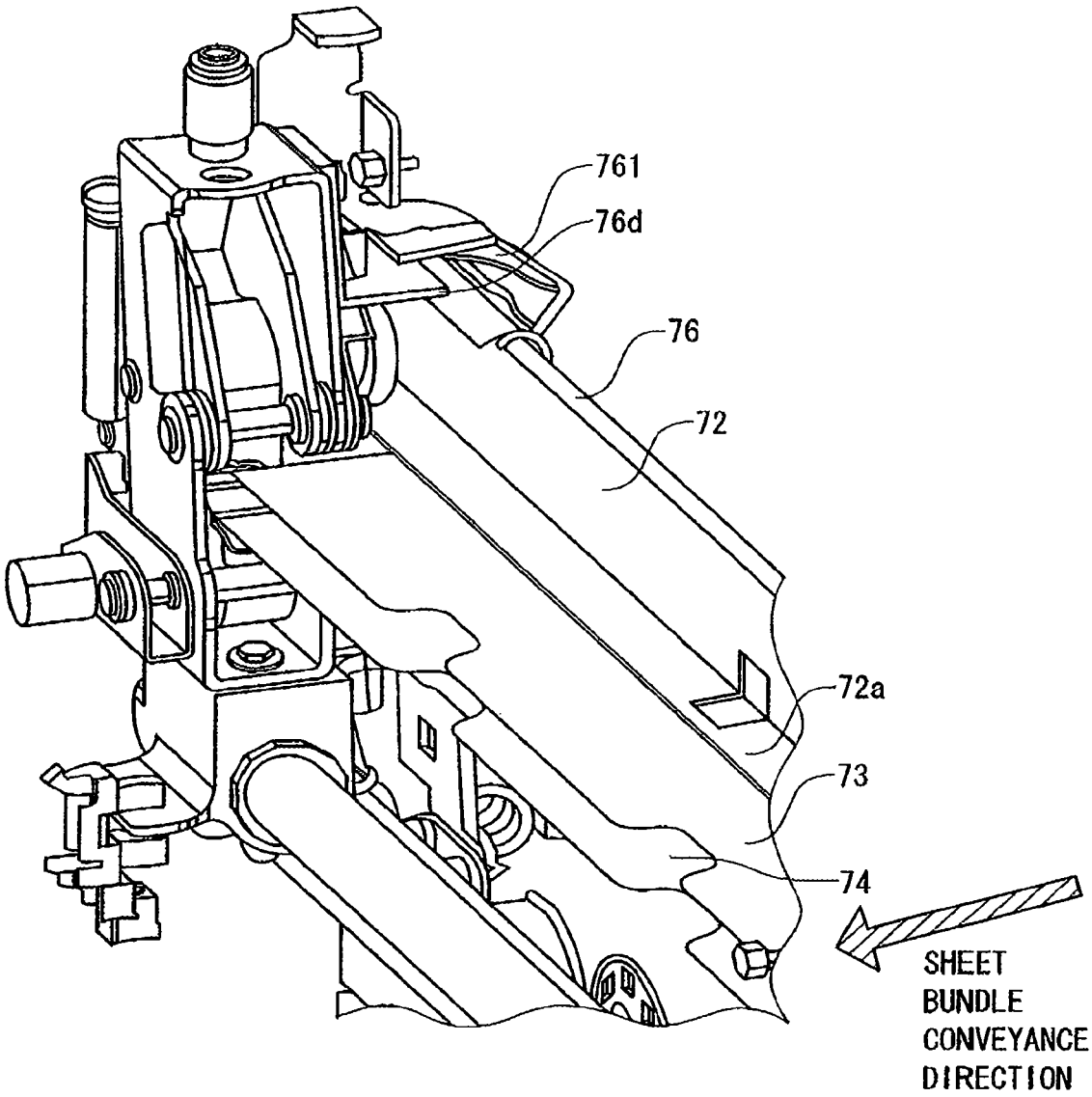
FIG. 11 is a first view showing a drive structure used for up-and-down driving of a conveyance guide.
Figure 12:
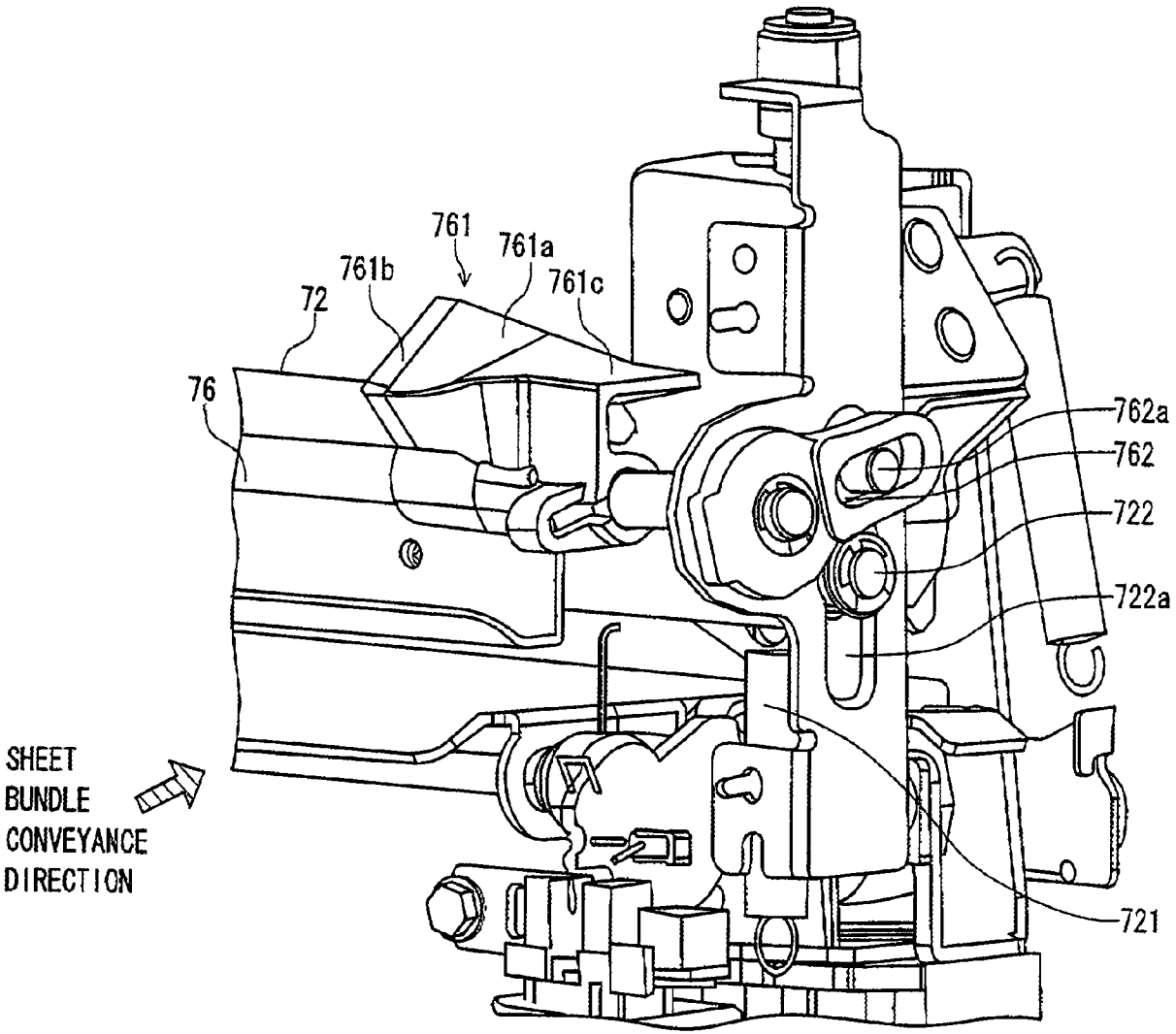
FIG. 12 is a second view showing the drive structure used for the up-and-down driving of the conveyance guide.

FIG. 11 and FIG. 12 are views showing a drive structure used for the up-and-down driving of the conveyance guide 72.

As shown in FIG. 11 and FIG. 12, the drive shaft 76 used for the up-and-down driving of the conveyance guide 72 is disposed between the conveyance guide 72 and the fold roller pair 38. A cam member 761 is fixed to one end of the drive shaft 76 at the home position side.

As shown in FIG. 12, the cam member 761 includes a twisted section 761*a* formed into a twisted shape of a plate member, a horizontal section 761*c* continuous to the twisted section 761*a*, and a leading section 761*b* at the opposite side of the horizontal section 761*c*.

A lever member 762 is fixed to the drive shaft 76 at the leading end of the cam member 761 on the home position side. The leading section of the lever member 762 is provided with a long hole 762*b*, and the lever roller 762*a* fixed to the end of the conveyance guide 72 is slidably inserted in the long hole 762*b*.

Besides, a bearing member 722 is fixed to the end of the conveyance guide 72, and the bearing member 722 is inserted in a long hole 722*a* formed in the roller frame 67 of the roller unit 60 and can slide in the up-and-down direction.

The end of the bottom plate 72*a* of the conveyance guide 72 on the home position side and the bottom plate 713 of the frame 71 are spring coupled by a conveyance guide spring 721, and the conveyance guide 72 is pulled downward (direction toward the bottom plate 713) by the pulling force of the conveyance guide spring 721.

Next, the movement of these drive structures will be described with reference to FIG. 13A to FIG. 13D.

Figures 13A, 13B, 13C, 13D:
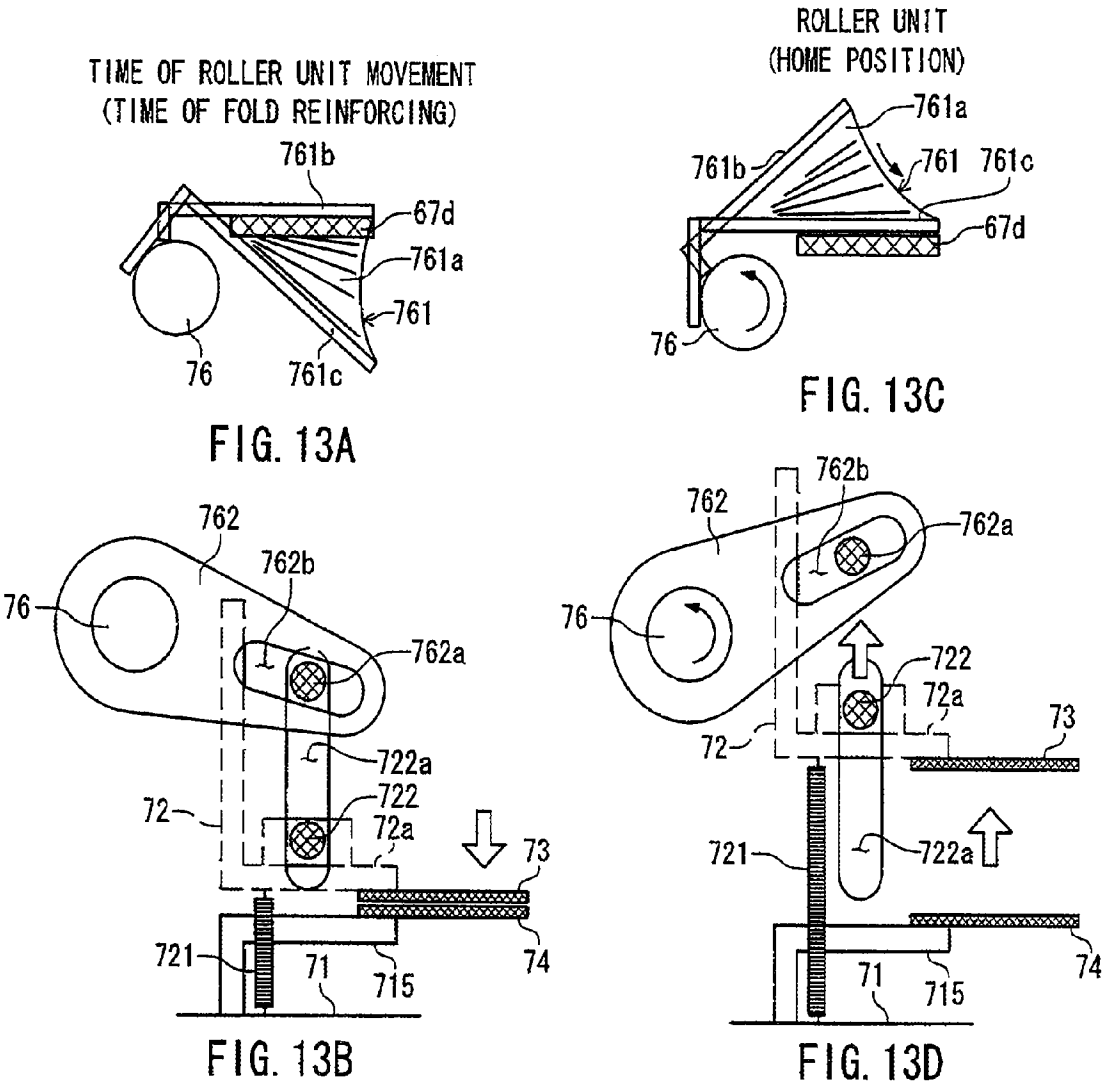
FIGS. 13A to 13D are views for schematically explaining movement of the up-and-down drive structure of the conveyance guide.

FIG. 13A and FIG. 13B are views of a state where the roller unit 60 goes away from the home position and moves, that is, reinforces the fold.

FIG. 13A is a view showing a positional relation between the cam member 761 fixed to the drive shaft 76 and a conveyance guide support table 67*d*. The roller unit 60 includes the conveyance guide support table 67*d* horizontally extending from the roller frame 67 (see FIG. 11, FIG. 6). When the roller unit 60 is separate from the home position, the cam member 761 and the conveyance guide support table 67*d* are at separate positions, and do not interfere with each other.

On the other hand, at the time of reinforcing the fold, as shown in FIG. 13B, the conveyance guide 72 is pulled downward by the pulling force of the conveyance guide spring 721, and the bottom plate 72*a* (and the flexible member 73) of the conveyance guide 72 is in a state where they are pressed against the sheet bundle loading table 715 (and the flexible member 74) through the sheet bundle (not shown).

At this time, the bearing member 722 fixed to the conveyance guide 72 and the lever roller 762*a* are also pulled downward, and the leading end of the lever member 762 is directed slightly downward and is in a stop state. As shown in FIG. 13A, the leading section 761*b* of the cam member 761 is stopped at the position where it is parallel to the conveyance guide support table 67*d* of the roller unit 60.

The roller unit 60 reaches the opposite side of the home position and when again returns to the vicinity of the home position, the conveyance guide support table 67*d* of the roller unit 60 first contacts with the lower surface of the leading section 761*b* of the cam member 761.

Thereafter, when the roller unit 60 is further moved to the home position side, the conveyance guide support table 67*d* moves while sliding on the lower surface of the twisted section 761*a* of the cam member 761. At this time, an upward force to the cam member 761 is generated by the curve of the twisted section 761*a*, and rotates the drive shaft 76 fixed to the cam member 761 (rotates it in the counterclockwise direction in FIG. 13C).

When the drive shaft 76 rotates, the lever member 762 also rotates in the same direction, and the leading end of the lever member 762 moves up. As a result, the lever roller 762*a* inserted in the long hole 762*b* of the lever member 762 is pulled upward, and the conveyance guide 72 fixed to the lever roller 762*a* is also moved upward against the pulling force of the conveyance guide spring 721.

When the roller unit 60 is completely returned to the home position, the conveyance guide support table 67*d* of the roller unit 60 passes the twisted section 761*a* of the cam member 761, reaches the horizontal section 761*c*, and stops here.

A force to cause downward movement is applied to the conveyance guide 72 by the pulling force of the conveyance guide spring 721. However, at the home position, the horizontal section 761*c* of the cam member 761 is put on the upper surface of the conveyance guide support table 67*d*, it cannot move downward. Thus, the drive shaft 76 and the lever member 762 are in the state where the rotation in the clockwise direction is inhibited, and the lever roller 762*a* and the conveyance guide 72 fixed thereto can not move downward.

As stated above, when the roller unit 60 is at the home position, the conveyance guide 72 and the flexible member 73 are held in the state where they are elevated.

In this state, the sheet bundle whose fold is already reinforced is pushed out by the rotation of the fold roller pair 38, and is conveyed to the sheet bundle loading section 40. The sheet bundle whose fold is to be reinforced from now is conveyed in this state so that the fold is positioned between the flexible members 73 and 74.

When the roller unit 60 goes away from the home position in order to reinforce the fold, the movement is opposite to the above movement. When the roller unit 60 starts to go away from the home position, the conveyance guide support table 67*d* of the roller unit 60 is moved from the horizontal section 761*c* of the cam member 761 to the position of the twisted section 761*a*. The drive shaft 76 receives a clockwise force caused by the pulling force of the conveyance guide spring 721, and is gradually rotated in the clockwise direction while the conveyance guide support table 67*d* moves along the curved section of the twisted section 761*a*. The lever member 762 is also rotated in the clockwise direction by this, and the lever roller 762*a*, the bearing member 722, and the conveyance guide 72 fixed to these move down. Finally, the bottom plate 72*a* of the conveyance guide 72 and the flexible member 73 reach the sheet bundle, and the downward movement stops at the stage where the sheet bundle is pressed by the pulling force of the conveyance guide spring 721.

Up here, the description is given to the lateral movement of the roller unit 60 along the fold of the sheet bundle, the up-and-down movement of the upper roller 51*a* in the roller unit 60, and the up-and-down movement of the conveyance guide 72, and these movements are roughly summarized as follows.

(a) When the roller unit 60 is at the home position, the conveyance guide 72 and the upper flexible member 73 are elevated upward. Besides, the upper roller 51*a* in the roller unit 60 is also elevated upward.

Incidentally, the positions of the sheet bundle loading table 715 and the lower flexible member 74 in the up-and-down direction are almost the same position as the nip of the fold roller pair 38, and are always constant irrespective of the movement of the roller unit 60. Similarly, the position of the lower roller 51*b* in the roller unit 60 in the up-and-down direction is always constant irrespective of the movement of the roller unit 60, and the position of the upper end of the lower roller 51*b* is set to almost the same position as the lower flexible member 74.

(b) When the roller unit 60 is at the home position, the sheet bundle passes through the nip of the fold roller pair 38 and is conveyed, and when the fold reaches between the flexible members 73 and 74, the conveyance of the sheet bundle is once stopped.

(c) Here, the drive motor 81 is driven, and the roller unit 60 starts the lateral movement by the unit drive belt 87 and starts to go away from the home position.

(d) When the roller unit 60 goes away from the home position, the conveyance guide 72 and the upper flexible member 73 move down, and press the sheet bundle from above by the bottom plate 72*a* of the conveyance guide 72 (operation of FIG. 13A to FIG. 13D). The pressing force is the force caused by the pulling force of the conveyance guide spring 721. The downward operation of the conveyance guide 72 is completed before the roller unit 60 reaches the effective drive range, and the state is such that the fold of the sheet bundle is nipped by the upper and the lower flexible members 73 and 74.

(e) When the roller unit 60 goes away from the home position, the upper roller 51*a* in the roller unit 60 also starts to move down. The upper roller presses (operation of FIG. 10) the upper surface of the upper flexible member 73 whose downward operation is completed. At this time, the lower roller 51*b* exists at the lower surface of the lower flexible member 74, and the upper and the lower flexible members 73 and 74 are pressed by the upper roller 51*a* and the lower roller 51*b*. The pressing force is caused by the pulling force of the spring 68 in the roller unit 60.

(f) Thereafter, the roller unit 60 is moved in accordance with the movement of the unit drive belt 87. When the roller unit 60 comes to the position of the sheet bundle, the upper roller 51*a* runs onto the sheet bundle through the upper flexible member 73, and moves along the fold while pressing the fold of the sheet bundle. When the roller unit 60 reaches the end on the opposite side of the home position, the movement of the unit drive belt 87 is reversed, and the roller unit moves on the return path along the fold while pressing the fold of the sheet bundle. Finally, return is made to the home position.

As described above, in the fold reinforcing unit 50 of the embodiment, since the sheet bundle is nipped by the reinforce roller pair 51 through the upper and the lower flexible members 73 and 74, the sheet is not turned up at the edge of the sheet bundle. Besides, since the reinforce roller pair 51 does not directly contact with the fold, a wrinkle or a flaw is not generated on the fold.

Besides, since the conveyance guide 72 which can be driven in the up-and-down direction is provided, and the conveyance guide 72 applies the pressure to the sheet bundle and presses it, even if the reinforce roller pair 51 moves along the fold, the sheet bundle does not shift in the lateral direction.

Hitherto, in order to prevent the sheet bundle from shifting in the lateral direction, a structure is proposed in which a stop member is provided at the edge of the sheet bundle. However, the position of the stop member as stated above must be changed according to the size of the sheet, and this is inconvenient.

On the other hand, in this embodiment, since the structure is such that the sheet bundle is pressed by the conveyance guide 72 having a sufficient width to cover the width of the maximum sheet size (for example, A3 size), the lateral shift of the sheet bundle can be prevented irrespective of the sheet size.

Besides, the fold reinforcing unit 50 of this embodiment includes the conveyance guide roller 64 to further press the conveyance guide 72. As shown in FIG. 6, the conveyance guide roller 64 is attached to the upper link member 65 of the roller unit 60. When the roller unit 60 goes away from the home position, similarly to the upper roller 51*a*, the conveyance guide roller 64 moves down and presses the bottom plate 72*a* of the conveyance guide 72 from above (see FIG. 5A and FIG. 5B). The moving down of the conveyance guide roller 64 is realized by the same mechanism as the moving down of the upper roller 51*a*. The conveyance guide 72 is pressed by the conveyance guide roller 64 in addition to the pulling force of the conveyance guide spring 721, and the prevention of the lateral shift of the sheet bundle is reinforced.

Here, a point to be noted is that in this embodiment, the three independent movements, that is, the lateral movement of the roller unit 60, the up-and-down movement of the upper roller 51*a* (and the conveyance guide roller 64) in the roller unit 60, and the up-and-down movement of the conveyance guide 72 are realized by the single drive source, that is, by only the drive motor 81, not by plural independent drive sources. As a result, the number of drive motors is reduced, which contributes to the reduction in cost and reduction in electric power. When the respective independent movements are attempted to be realized by plural drive motors, synchronization of the mutual movements must be taken, and a control circuit for that becomes complicated. On the other hand, in this embodiment, since the respective movements are realized by the single drive motor 81, a synchronous control circuit between the drive motors is unnecessary.

(3) Contact and Separation Position of the Reinforce Roller Pair

As described above, when the reinforce roller pair 51 (or the roller unit 60) is at the home position, the upper roller 51*a* and the lower roller 51*b* are separate from each other. When the reinforce roller pair 51 goes away from the home position and starts to move, the upper roller 51*a* comes close to the lower roller 51*b*. At the position where the guide roller 66*c* of the roller unit 60 moves to the end of the inclined section 77*a* of the guide rail 77, the upper roller 51*a* and the lower roller 51*b* are pressed to each other by the elastic force (urging force) of the spring 68 and contact with each other (see FIG. 10). A range away this position is originally intended to be a range where the fold can be effectively reinforced.

However, when the position where the upper roller 51*a* and the lower roller 51*b* contact with each other is made excessively close to the home position, there can occur a state where the upper roller 51*a* can not get over the edge of the large size sheet bundle.

When the distance between the home position and the edge of the sheet bundle is short, the upper roller 51*a* and the lower roller 51*b* contact with each other in the state where a sufficient speed (run-up speed) can not be obtained, and reach the edge of the sheet bundle immediately. Since the sufficient run-up speed is not obtained, the downward urging force based on the spring 68 is larger than the upward force for getting over the edge of the sheet bundle, and the upper roller 51*a* can not get over the edge of the sheet bundle. As a result, the upper roller 51*a* and the lower roller 51*b* continue to press the edge of the sheet bundle in the state where the sheet bundle is not nipped, and curling or a wrinkle occurs at the edge of the sheet bundle.

In order to avoid the state as stated above, in the sheet finisher 20 of this embodiment, as shown in FIG. 19A, when the upper roller 51*a* and the lower roller 51*b* move to the position where they pass the edge of the sheet bundle of the maximum size (for example, A3 size) which can be processed by the apparatus, the upper roller 51*a* and the lower roller 51*b* come close to each other, and mutually press the fold of the sheet bundle to reinforce the fold. At this position, although the upper roller 51*a* and the lower roller 51*b* do not reach the sufficient run-up speed, since they already move to the position where they pass the edge of the sheet bundle, it is not necessary to originally get over the edge. Accordingly, with respect to the sheet bundle of the maximum size, there does not occur the problem that the edge is kept pressed and curling or a wrinkle occurs, and the fold can be excellently reinforced.

Figure 14A:
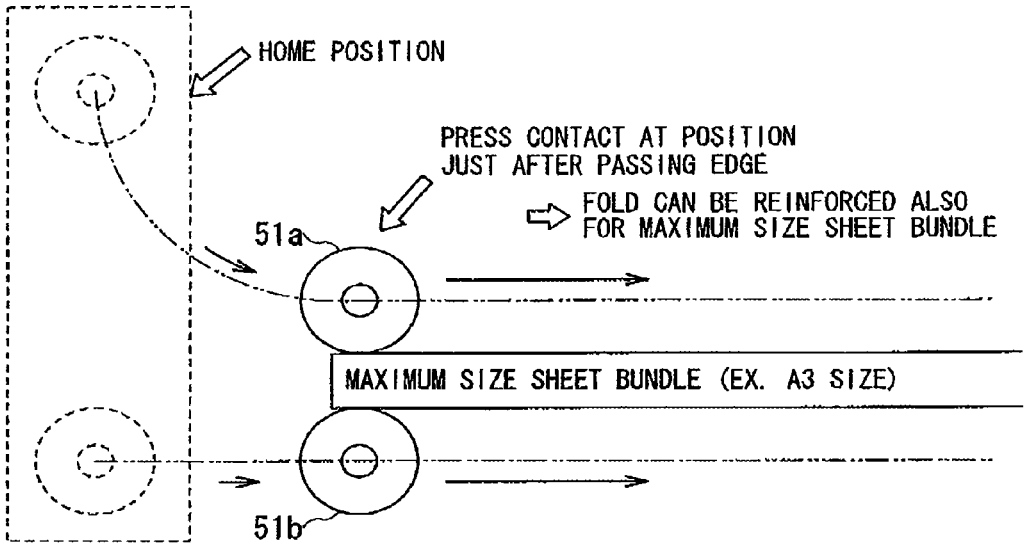
FIG. 14A is a view showing a positional relation between a separate and contact position of a reinforce roller pair of the embodiment and a sheet bundle of a maximum size.
Figure 14B:
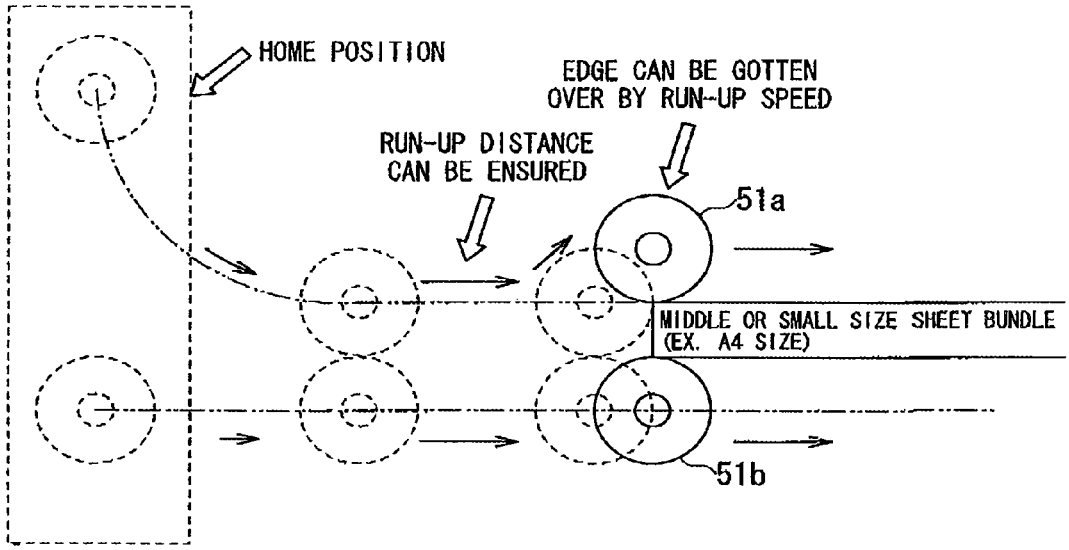
FIG. 14B is a view showing a positional relation between a separate and contact position of the reinforce roller pair of the embodiment and a sheet bundle of a size smaller than the maximum size.

When the sheet size is smaller than the maximum sheet size (for example, A4 size or a size less than that), as shown in FIG. 14B, after the upper roller 51*a* and the lower roller 51*b* come in press contact with each other, a sufficient run-up distance to the edge of the sheet bundle can be ensured. Thus, when the upper roller 51*a* and the lower roller 51*b* reach the edge of the sheet bundle, the sufficient run-up speed is obtained, and the upper roller 51 can easily get over the edge of the sheet bundle. Accordingly, the fold can be excellently reinforced for the sheet bundle of a size smaller than the maximum sheet size.

As described above, according to the sheet finisher 20, the image forming apparatus 10 and the sheet finishing method of the embodiment, from a small size to a large size and irrespective of the size of the sheet, the fold can be stably and excellently reinforced without causing curling or a wrinkle at the edge of the sheet bundle.

The invention is not directly limited to the respective embodiments, and can be embodied by modifying the components within the range not departing from the gist. Besides, the invention of various embodiments can be formed by suitable combinations of plural components disclosed in the respective embodiments. For example, some components may be deleted from all components disclosed in the embodiment. Further, components of different embodiments may be suitably combined.

What is claimed is:

1. A sheet finisher comprising:

a saddle-stitching unit configured to stitch a center of a sheet bundle;

a folding unit configured to fold the center and to form a fold;

first and second rollers that move along a direction of the fold while nipping and pressing the fold of the sheet bundle conveyed from the folding unit and reinforce the fold; and a drive section configured to move the first and second rollers along the direction of the fold from a standby position apart from an edge of the sheet bundle, wherein the first and second rollers are separate from each other in a thickness direction of the sheet bundle at the standby position, and after the first and second rollers reach a position where the first and second rollers pass the edge of the sheet bundle of a processable maximum size, the first and second rollers come close to each other in the thickness direction and nip the fold.

2. The finisher according to claim 1, wherein a position of the first roller is fixed in the thickness direction of the sheet bundle, and a position of the second roller is movable in the thickness direction of the sheet bundle.

3. The finisher according to claim 2, further comprising an elastic member to urge the second roller to press against the first roller.

4. The finisher according to claim 3, wherein when the sheet bundle whose fold is to be reinforced has a size smaller than the maximum size, the second roller once comes close to the first roller at an outside of a width of the sheet bundle, and when the first and second rollers reach a position of an edge of the sheet bundle, the second roller runs onto the edge of the sheet bundle against an urging force of the elastic member, and then, moves along the fold while nipping and pressing the fold in cooperation with the first roller.

5. The finisher according to claim 3, further comprising:

a roller frame to contain the first and second rollers, a first link member one end of which is axially fixed to the roller frame, and a second link member one end of which is axially fixed to the roller frame, wherein the elastic member is a pulling spring, the other end of the first link member is engaged with one end of the pulling spring, the other end of the second link member is engaged with the other end of the pulling spring, a rotation shaft of the first roller is fixed to the roller frame between the one end of the first link member and the other end, a rotation shaft of the second roller is fixed to the second link member between the one end of the second link member and the other end, and the first roller and the second roller are pressed against each other by a pulling force of the pulling spring.

6. An image forming apparatus comprising:

a reading section configured to read an original document and to form image data;

an image forming section configured to print the image data on a sheet;

a saddle-stitching unit configured to stitch a center of a printed sheet bundle;

a folding unit configured to fold the center and to form a fold;

first and second rollers that move along a direction of the fold while nipping and pressing the fold of the sheet bundle conveyed from the folding unit and reinforce the fold; and a drive section configured to move the first and second rollers along the direction of the fold from a standby position apart from an edge of the sheet bundle, wherein the first and second rollers are separate from each other in a thickness direction of the sheet bundle at the standby position, and after the first and second rollers reach a position where the first and second rollers pass the edge of the sheet bundle of a processable maximum size, the first and second rollers come close to each other in the thickness direction and nip the fold.

7. The apparatus according to claim 6, wherein a position of the first roller is fixed in the thickness direction of the sheet bundle, and a position of the second roller is movable in the thickness direction of the sheet bundle.

8. The apparatus according to claim 7, further comprising an elastic member to urge the second roller to press against the first roller.

9. The apparatus according to claim 8, wherein when the sheet bundle whose fold is to be reinforced has a size smaller than the maximum size, the second roller once comes close to the first roller at an outside of a width of the sheet bundle, and when the first and second rollers reach a position of an edge of the sheet bundle, the second roller runs onto the edge of the sheet bundle against an urging force of the elastic member, and then, moves along the fold while nipping and pressing the fold in cooperation with the first roller.

10. The apparatus according to claim 8, further comprising:

a roller frame to contain the first and second rollers, a first link member one end of which is axially fixed to the roller frame, and a second link member one end of which is axially fixed to the roller frame, wherein the elastic member is a pulling spring, the other end of the first link member is engaged with one end of the pulling spring, the other end of the second link member is engaged with the other end of the pulling spring, a rotation shaft of the first roller is fixed to the roller frame between the one end of the first link member and the other end, a rotation shaft of the second roller is fixed to the second link member between the one end of the second link member and the other end, and the first roller and the second roller are pressed against each other by a pulling force of the pulling spring.

11. A sheet finishing method comprising;

stitching a center of a sheet bundle;

folding the center to form a fold; and reinforcing the fold by nipping and pressing the fold by first and second rollers and moving the first and second rollers along a direction of the fold, wherein in the reinforcing the fold, the first and second rollers are separated from each other in a thickness direction of the sheet bundle at a standby position apart from an edge of the sheet bundle, and after the first and second rollers reach a position where the first and second rollers pass the edge of the sheet bundle of a processable maximum size, the first and second rollers come close to each other in the thickness direction and nip the fold.

12. The method according to claim 11, wherein a position of the first roller is fixed in the thickness direction of the sheet bundle, and a position of the second roller is movable in the thickness direction of the sheet bundle.

13. The method according to claim 12, wherein the second roller is urged by an elastic member and is pressed against the first roller.

14. The method according to claim 13, wherein when the sheet bundle whose fold is to be reinforced has a size smaller than the maximum size, the second roller once comes close to the first roller at an outside of a width of the sheet bundle, and when the first and second rollers reach a position of an edge of the sheet bundle, the second roller runs onto the edge of the sheet bundle against an urging force of the elastic member, and then, moves along the fold while nipping and pressing the fold in cooperation with the first roller.

* * * * *